US010555587B2

(12) United States Patent
Yu

(10) Patent No.: US 10,555,587 B2
(45) Date of Patent: Feb. 11, 2020

(54) EXPANDABLE LUGGAGE

(71) Applicant: Travelers Club Luggage, Inc., La Palma, CA (US)

(72) Inventor: Peter Yu, La Palma, CA (US)

(73) Assignee: Travelers Club Luggage, Inc., La Palma, CA (US)

( * ) Notice: Subject to any disclaimer, the term of this patent is extended or adjusted under 35 U.S.C. 154(b) by 114 days.

(21) Appl. No.: 15/847,415

(22) Filed: Dec. 19, 2017

(65) Prior Publication Data

US 2019/0183219 A1 Jun. 20, 2019

(51) Int. Cl.

| | |
|---|---|
| ***A45C 7/00*** | (2006.01) |
| ***A45C 13/10*** | (2006.01) |
| ***A45C 5/03*** | (2006.01) |
| ***A45C 15/00*** | (2006.01) |
| ***A45C 13/26*** | (2006.01) |

(52) U.S. Cl.

CPC ..... *A45C 7/0027* (2013.01); *A45C 5/03* (2013.01); *A45C 13/103* (2013.01); *A45C 13/262* (2013.01); *A45C 15/00* (2013.01); *A45C 2013/267* (2013.01)

(58) Field of Classification Search

CPC ..... A45C 7/0027; A45C 5/03; A45C 13/103; A45C 13/262; A45C 15/00; A45C 2013/267

See application file for complete search history.

(56) References Cited

U.S. PATENT DOCUMENTS

| | | | | |
|---|---|---|---|---|
| 4,773,515 A * | 9/1988 | Kotkins, Jr. | ..... | A45C 7/0068 190/103 |
| 5,307,908 A | 5/1994 | Shyr et al. | | |
| 6,098,768 A * | 8/2000 | Tsai | ..... | A45C 5/14 16/429 |
| 6,298,964 B1 * | 10/2001 | Sadow | ..... | A45C 5/14 190/115 |

(Continued)

FOREIGN PATENT DOCUMENTS

| | | |
|---|---|---|
| CA | 2569680 | 11/2006 |
| WO | 2015006948 | 1/2015 |

OTHER PUBLICATIONS

Legal Advantage, "Patentability Search Report: The top extra packing space we have on the luggage", Jul. 2017, 14 pages.

*Primary Examiner* — Tri M Mai

(74) *Attorney, Agent, or Firm* — Lee, Hong, Degerman, Kang & Waimey

(57) ABSTRACT

An expandable luggage container includes a first compartment; a side cover formed on a side of the first compartment, a first zipping mechanism formed around three sides of the side cover; a second compartment coupled to the first compartment; and a top cover formed on a top side of the second compartment, a second zipping mechanism formed around three sides of the top cover. In the luggage container, a first opening of the first compartment and a second opening of the second compartment are directed to different directions; the second compartment is collapsible by a third zipping mechanism formed between the first compartment and second compartment; and the luggage container is in a compact mode when the second compartment is collapsed and is in an expanded mode when the second compartment is expanded by unzipping of the third zipping mechanism.

16 Claims, 5 Drawing Sheets

(56) References Cited

U.S. PATENT DOCUMENTS

| | | | | |
|---|---|---|---|---|
| 6,776,271 | B2 * | 8/2004 | Chen | A45C 7/0027 190/107 |
| 7,900,757 | B2 | 3/2011 | Sisitsky | |
| D643,215 | S * | 8/2011 | Lin | D3/279 |
| 8,567,577 | B2 * | 10/2013 | Jackson | A45B 23/00 190/109 |
| 8,869,960 | B2 | 10/2014 | Mangano | |
| 8,988,038 | B2 * | 3/2015 | Samuel | A45C 5/14 320/107 |
| 9,326,575 | B2 * | 5/2016 | Moore | A47B 3/10 |
| 2002/0023812 | A1 | 2/2002 | Bernbaum et al. | |
| 2005/0185916 | A1 | 8/2005 | Jost et al. | |
| 2010/0108452 | A1 * | 5/2010 | Williams | A45C 5/14 190/18 A |
| 2014/0353104 | A1 | 12/2014 | Sheikh et al. | |
| 2015/0101958 | A1 * | 4/2015 | Cross | A45C 5/14 206/702 |
| 2016/0325884 | A1 | 11/2016 | Kraeling et al. | |

* cited by examiner

EXPANDABLE LUGGAGE

BACKGROUND OF THE INVENTION

Field

The present invention relates generally to luggage containers. More specifically, the present invention relates to expandable luggage containers.

Background

A challenge to traveling has always been carrying one's belongings in the most efficient and easy manner. To meet this challenge, expandable luggage designs have appeared in the prior art to allow carrying additional items when expanded. However, prior art designs merely allow expansion of a limited portion of the luggage to a certain degree such that the storage space of the expanded luggage may not be sufficient to accommodate extra contents that require a larger storage space. Further, even if luggage may be expanded sufficiently to accommodate a large amount of contents, such expanded luggage may not satisfy size and/or weight limitations required for checking in baggage for air travel.

Moreover, recently, airlines started charging checked baggage fees even for a first checked bag. Therefore, whenever a bag is checked, the checked baggage fee may be burdensome to some travelers. For that reason, now many travelers try to reduce the size of their luggage so that they can carry on their luggage without paying the checked baggage fees. However, if the size of a luggage container surpasses the size limitation, such a luggage container must be checked at an airport regardless of the amount of actual contents in the luggage container. Therefore, a solution is necessary to avoid such inconvenience and burden arising due to the size of luggage.

SUMMARY OF THE INVENTION

Accordingly, embodiments of the present invention are directed to an improved luggage apparatus that substantially obviates one or more of the problems due to limitations and disadvantages of the related art. According to one embodiment of the present invention, an expandable luggage container includes a first compartment; a side cover formed on a lateral side of the first compartment, a first zipping mechanism formed around three sides of the side cover; a second compartment coupled to the first compartment; and a top cover formed on a top side of the second compartment, a second zipping mechanism formed around three sides of the top cover. In the luggage container, a first opening of the first compartment and a second opening of the second compartment are directed to different directions; the second compartment is collapsible by a third zipping mechanism formed between the first compartment and second compartment; and the luggage container is in a compact mode when the second compartment is collapsed and is in an expanded mode when the second compartment is expanded by unzipping of the third zipping mechanism.

In one aspect of the present invention, the first compartment and the second compartment are connected such that a single expanded compartment is formed in the expanded mode. In another aspect of the present invention, the luggage container further includes a spacer formed between the first compartment and the second compartment such that two separate compartments are formed in the expanded mode.

In one aspect of the present invention, the luggage container is sized to be a carry-on luggage for air travels in the compact mode such that the luggage container is storable under a seat of a plane. In further aspect of the present invention, a size of the second compartment is smaller than a size of the first compartment.

In one aspect of the present invention, the third zipping mechanism is formed below the second zipping mechanism. In further aspect of the present invention, tracks of the third zipping mechanism are longer than tracks of the second zipping mechanism.

In one aspect of the present invention, the third zipping mechanism is formed along four lateral sides of the luggage container. In further aspect of the present invention, the third zipping mechanism is fully unzipped to place the luggage container in the expanded mode when a slider is moved at least 360 degrees.

In further aspect of the present invention, the luggage container further includes a retractable telescopic pull hand that is configured to be stored in a back pocket formed at a back side of the luggage container when the pull hand is completely retracted. Further, the back pocket has a fourth zipping mechanism; and the pull hand is extended from the back pocket when the back pocket is open by the fourth zipping mechanism. Furthermore, the second compartment includes a passage formed on a back side of the second compartment; the passage is concealed in the compact mode; and the extended pull hand passes through the passage in the expanded mode.

In one aspect of the present invention, the luggage container further includes a Universal Serial Bus (USB) port on a side of the first compartment. In further aspect of the present invention, the luggage container further includes a cable coupled to the USB port and an inner pocket formed inside the first compartment and sized and configured to receive an electronic device or a battery pack to be coupled to the cable.

In one aspect of the present invention, the second compartment is configured to receive a small item sized to be placed in the collapsed second compartment when the top cover is open in the compact mode. In further aspect of the present invention, the luggage container may also include a carrying handle formed on the top cover.

According to an aspect of the present invention, each of the first zipping mechanism and the second zipping mechanism includes two sliders. In further aspect of the present invention, the third zipping mechanism includes only one slider.

According to an embodiment of the present invention, an expandable luggage container includes a first compartment; a side cover formed on a side of the first compartment, a first zipping mechanism formed around three sides of the side cover; a second compartment; a top cover formed on a top side of the second compartment, a second zipping mechanism formed around three sides of the top cover; and a spacer formed between the first compartment and the second compartment. In the luggage container, a first opening of the first compartment is directed to a horizontal direction and a second opening of the second compartment is directed to a vertical direction; the second compartment is collapsible by a third zipping mechanism formed between the first compartment and second compartment; the luggage container is in a compact mode when the second compartment is collapsed and is in an expanded mode when the second compartment is expanded by unzipping of the third zipping mechanism; and a size of the second compartment is variable such that the second compartment is sized and configured to receive a larger item in the expanded mode while the second compartment is sized and configured to receive a smaller item in the compact mode. In one aspect of the present invention, a size of the first compartment is fixed regardless of whether the luggage container is in the compact mode or in the expanded mode.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings. Therefore, it is to be understood that both the foregoing general description and the following detailed description are exemplary and explanatory and are intended to provide a further explanation of the invention as claimed.

DETAILED DESCRIPTION OF EMBODIMENTS

Hereinafter, the present invention will be described with respect to the embodiment(s) illustrated in the annexed drawings.

Figure 1A:
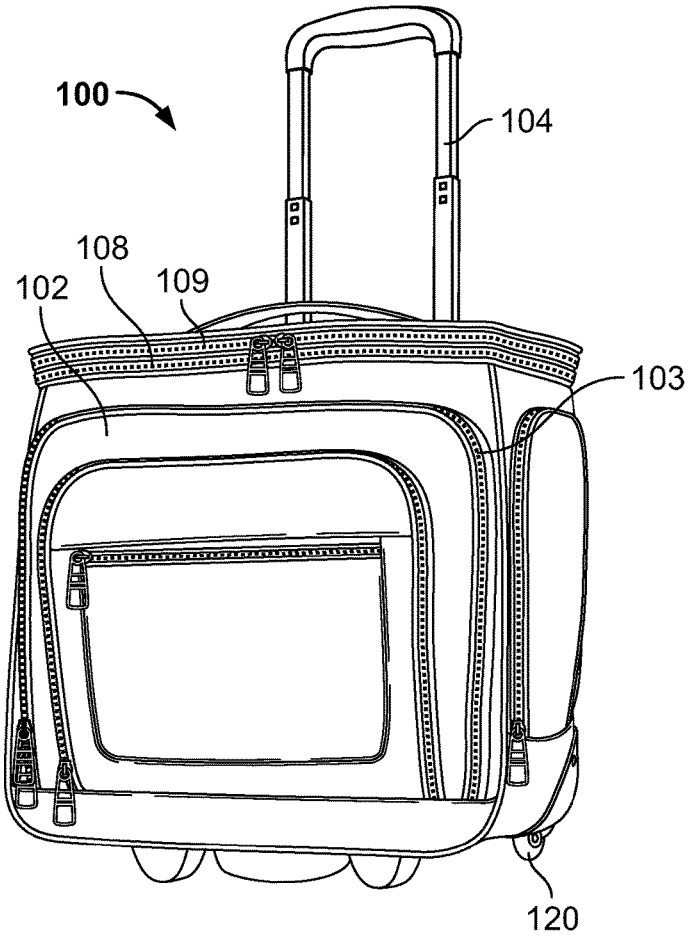
FIG. 1A is a perspective view of a luggage container in a compact mode according to an embodiment of the present invention.
Figure 1B:
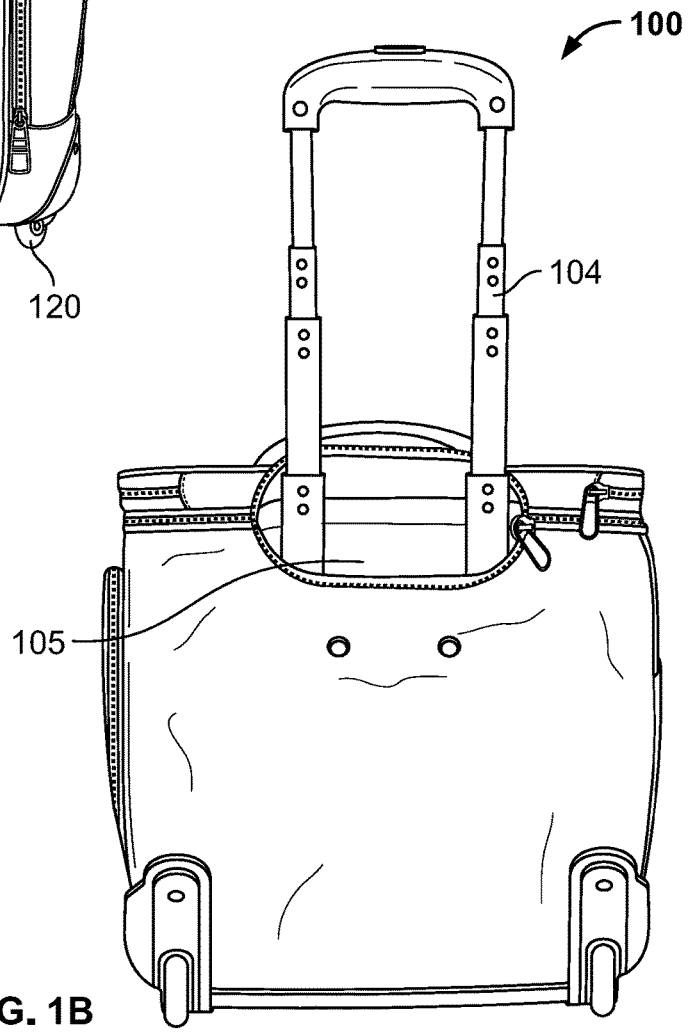
FIG. 1B is a rear view of a luggage container in a compact mode according to an embodiment of the present invention.
Figure 1C:
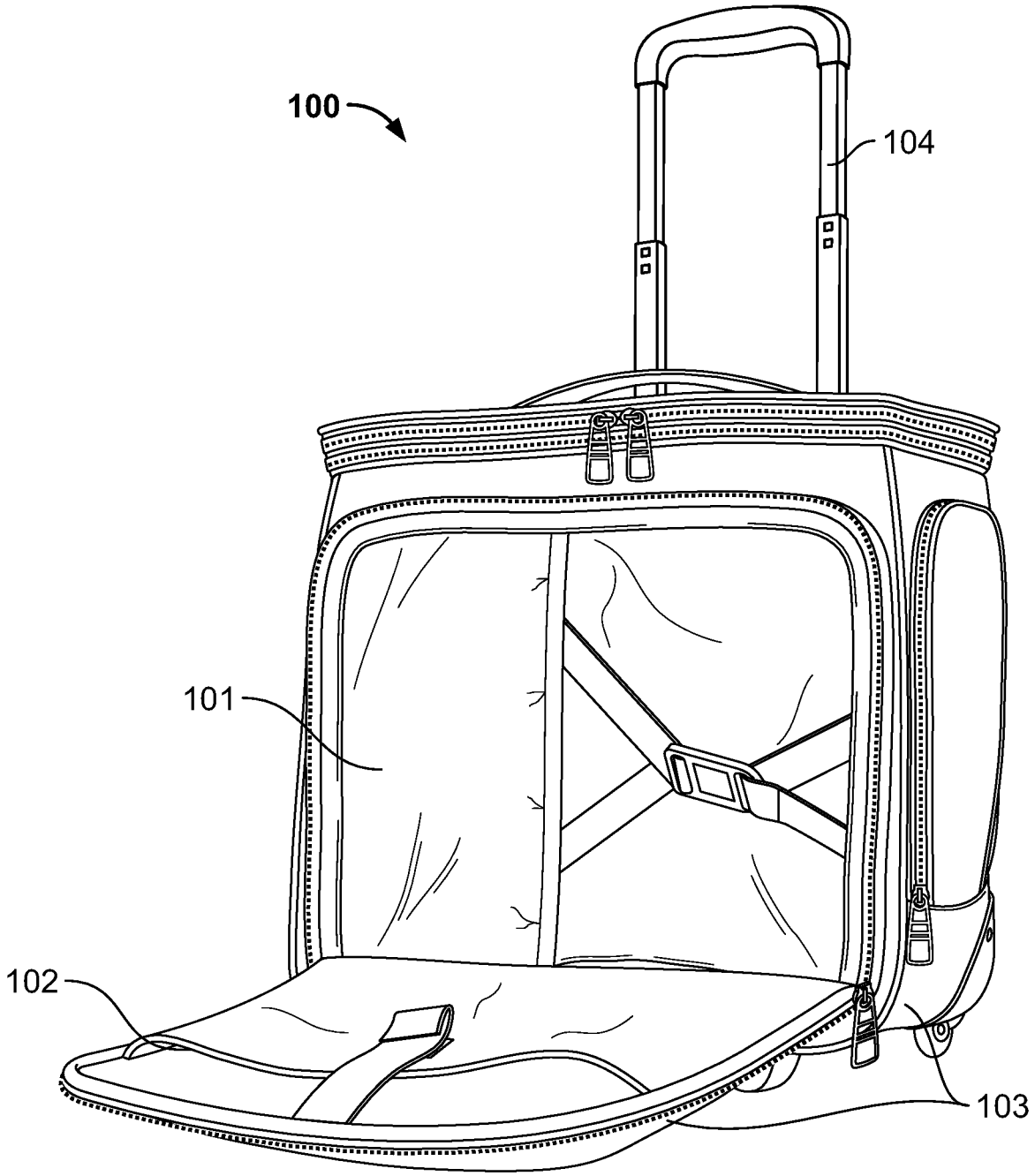
FIG. 1C shows an opening and a first compartment of a luggage container according to a n embodiment of the present invention.
Figure 2A:
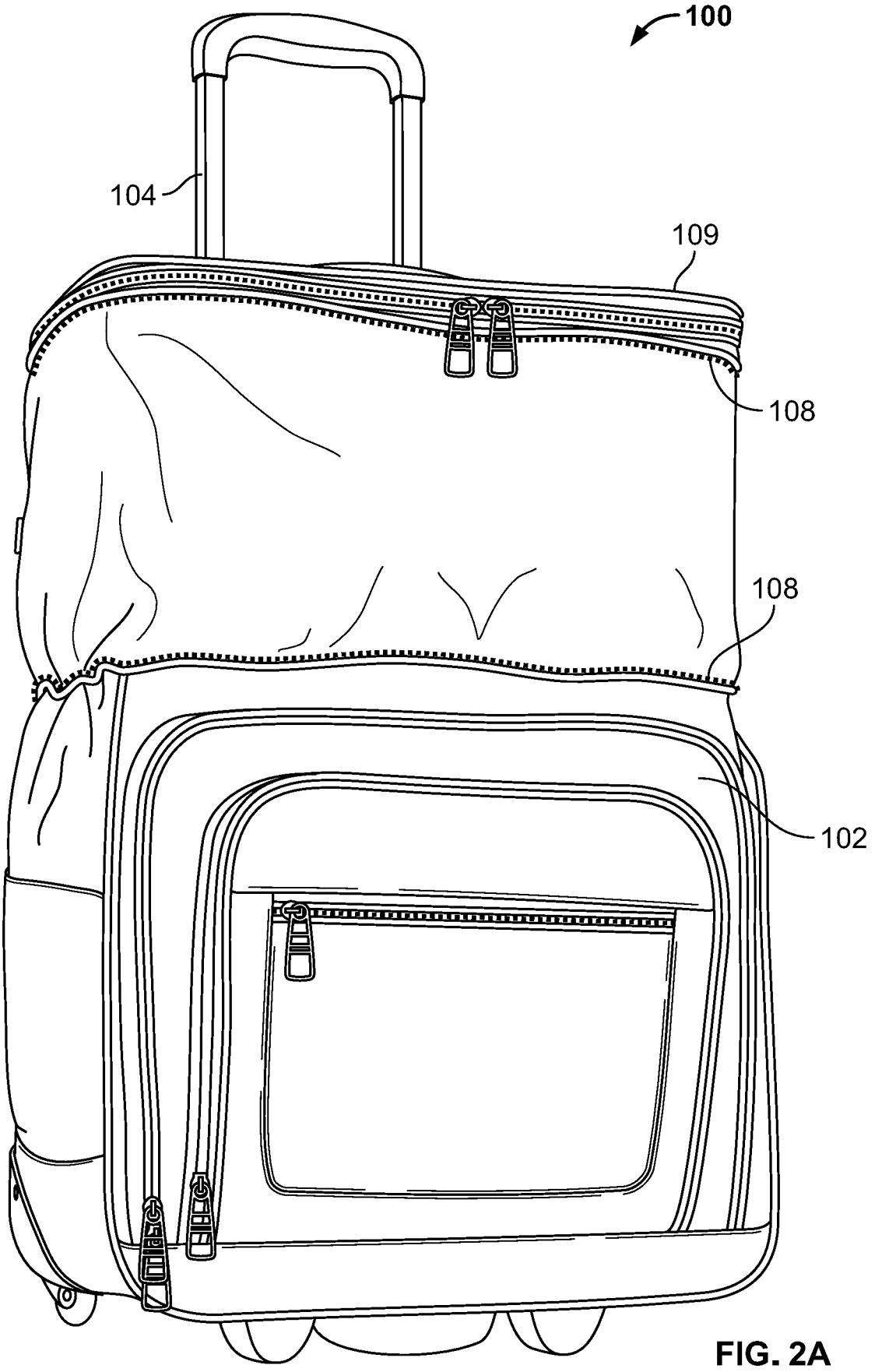
FIG. 2A is a perspective view of a luggage container in an expanded mode according to an embodiment of the present invention.
Figure 2B:
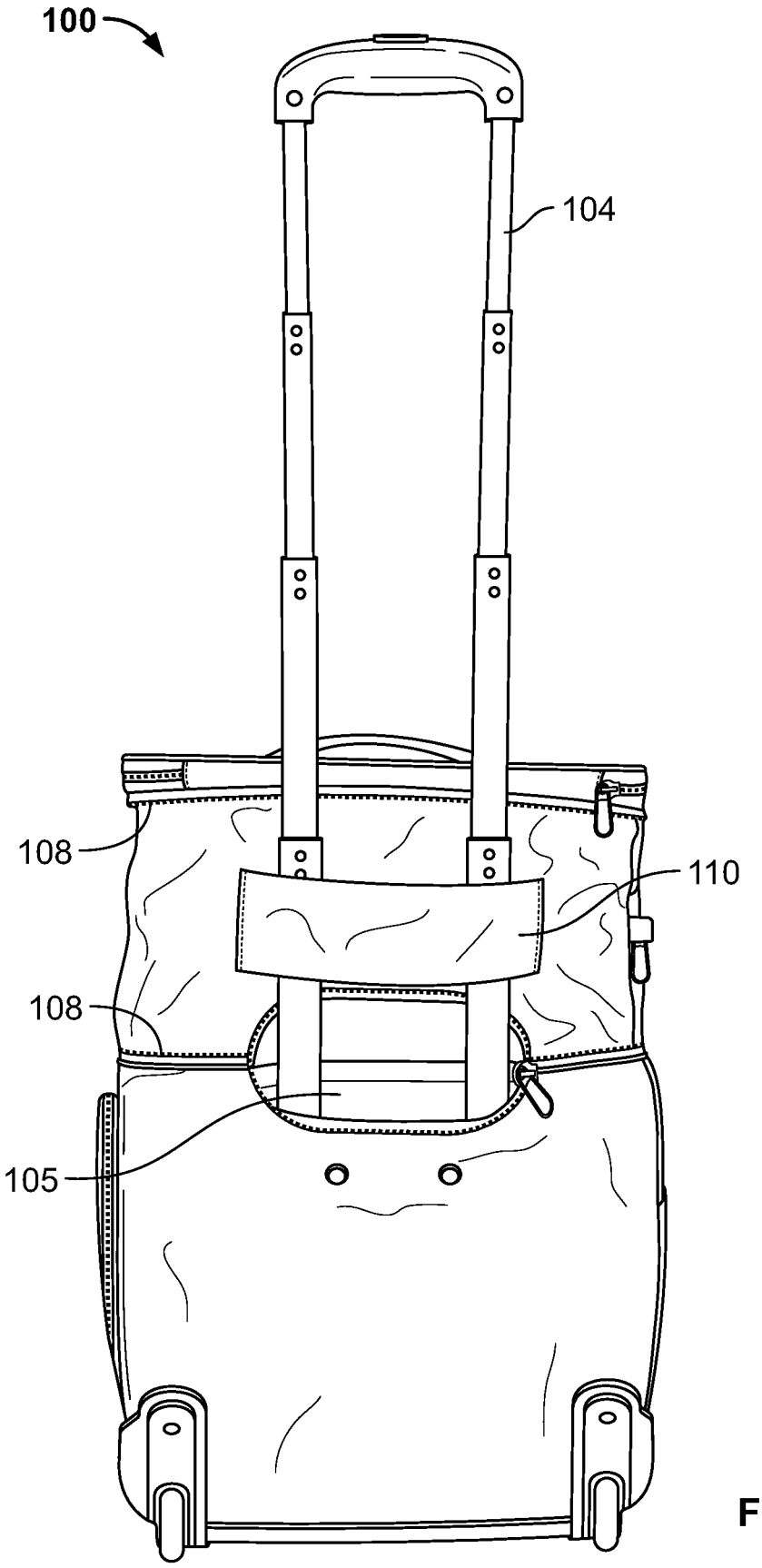
FIG. 2B is a rear view of a luggage container in an expanded mode according to an embodiment of the present invention.
Figure 2C:
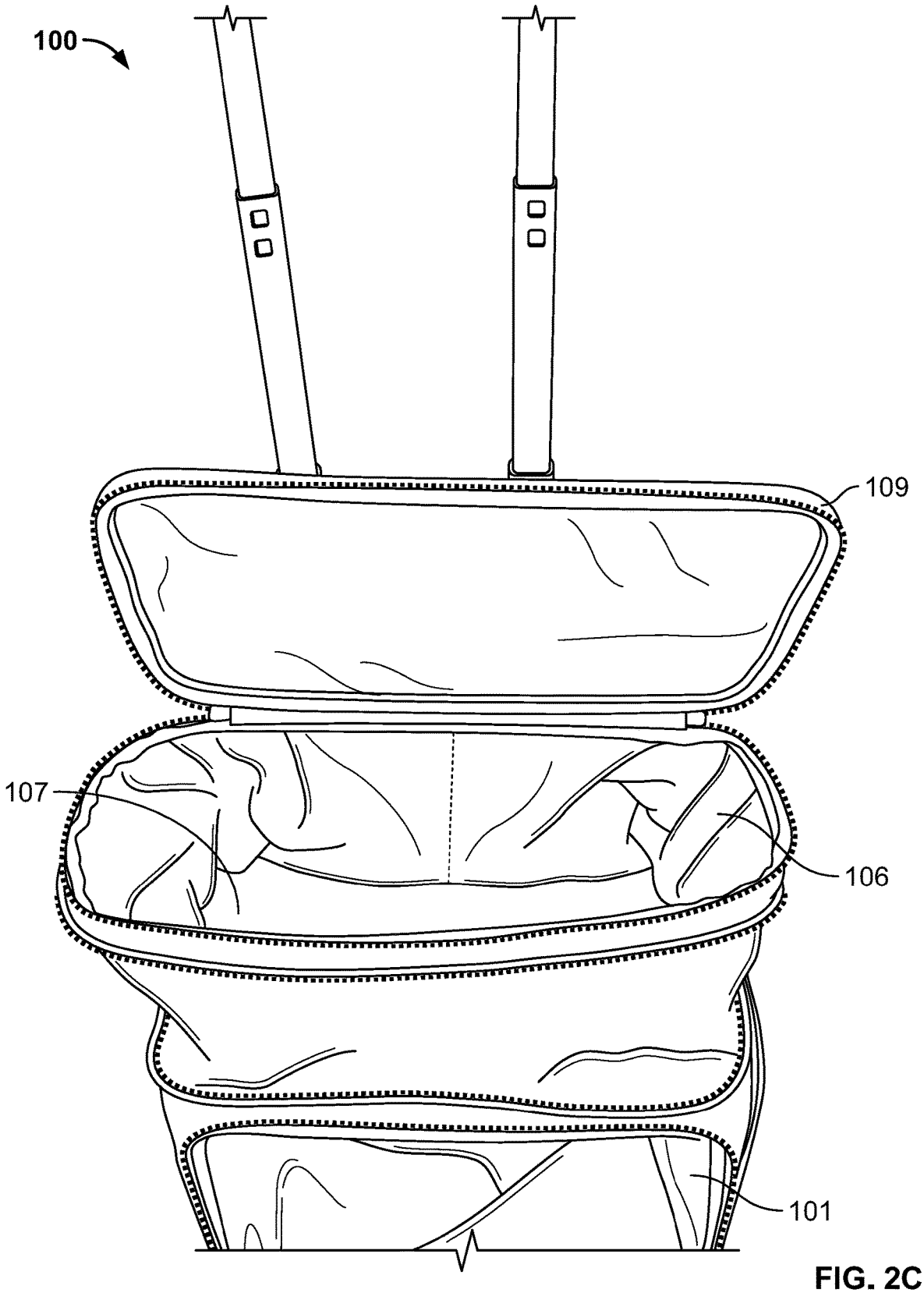
FIG. 2C shows openings of two separate compartments of a luggage container in an expanded mode according to an embodiment of the present invention.

FIGS. 1A-1C show a luggage container 100 that is in a compact mode. Referring to FIGS. 1A-1C, the luggage container 100 includes a first compartment 101 that is always available in a fixed size whether the luggage container 100 is in the compact mode or in an expanded mode, as shown in FIGS. 2A-2C.

According to an embodiment of the present invention, an opening of the first compartment 101 is at a side of the luggage container 100, the opening covered by a side cover 102. One side of the side cover 102 is coupled to a lower portion of the luggage container 100 and the side cover 101 has a zipping mechanism 103 formed on three sides of the side cover 102 such that the side cover 102 can be opened or closed by manipulating the zipping mechanism 103.

The luggage container 100 further includes a retractable telescopic pull handle 104 that is configured to be stored in a back pocket 105 formed on a back side of the luggage container 100 when the pull handle 104 is fully retracted or not in use. The back pocket 105 may be closed when the pull handle 104 is fully retracted and stored in the back pocket 105. The back pocket 105 may be open or closed by manipulating a zipping mechanism to extend or retract the telescopic pull handle 104 from the back pocket 105, as shown in FIGS. 1B and 2B.

According to an embodiment of the present invention, the luggage container 100 in the compact mode is sized to be a carry-on luggage for air travels such that the luggage container 100 may be stored under a seat or in a storage compartment of a plane. Preferably, the luggage container 100 is sized to be stored under the seat in the compact mode. The luggage container 100 in the expanded mode may still be sized to be a carry-on luggage to be stored in the storage compartment. Alternatively, the luggage container 100 in the expanded mode may be sized to be check-in. That is, depending on the size of the additional compartment generated when the luggage container 100 is converted from the compact mode to the expanded mode, the luggage container 100 in the expanded mode may be in a carry-on size or larger than the carry-on size.

FIGS. 2A-2C show a luggage container 100 that is in an expanded mode. Referring to FIGS. 2A-2C, the luggage container 100 in the expanded mode now includes a fully expanded second compartment 106 allowing storage of additional item(s) in the second compartment 106.

In one embodiment of the present invention, the first compartment 101 and the second compartment 106 are separated by a spacer 107 formed between the first compartment 101 and the second compartment 106, as shown in FIG. 2C, the spacer 107 used as a bottom of the second compartment 106. In another embodiment of the present invention, there is no spacer formed between the first compartment 101 and the second compartment 106 such that the first compartment 101 and the second compartment 106 are connected to form a single compartment, allowing storage of a long item, sized to occupy both the first compartment 101 and the second compartment 106, in the luggage container 100 that is in the expanded mode.

The luggage container 100 that is in the compact mode is expanded by manipulating a zipping mechanism 108 formed around all sides of the luggage container 100. For example, the zipping mechanism 108 is unzipped completely by moving a slider by at least or more than 360 degrees around the sides of the luggage container 100 such that collapsed sides of the second compartment 106 are expanded. In further example, tracks of the zipping mechanism 108 start from a middle portion located between an upper portion and a lower portion of the second compartment 106 at one side of the second compartment 106 such that the tracks are forked on the one side and the forked tracks are eventually formed at the upper portion and the lower portion in parallel on three sides of the second compartment 106 when the luggage container 100 is in the expanded mode. When the zipping mechanism 108 is zipped to place the luggage container 100 in the compact mode, all sides of the second compartment 106 are collapsed.

The second compartment 106 has its own cover, i.e., top cover 109. As shown in FIG. 2C, the directions of openings of the first compartment 101 and the second compartment 106 are different, the first compartment 101 opened from a side of the luggage container 100 and the second compartment 106 opened from a top side of the luggage container 100. The second compartment 106 also has a passage 110 formed on a backside of the second compartment 106 such that the extended telescopic pull handle 104 passes through the passage 110.

Further, according to an embodiment of the present invention, the luggage container 100 further includes wheels 120. The luggage container 100 may further include a Universal Serial Bus (USB) port on a side of the luggage container, the USB port connected to a cable that is provided to an inner pocket formed at an inner side of the luggage container 100 such that an electronic device or battery pack can be stored in the inner pocket and connected to the cable.

Those skilled in the art will appreciate that alternative embodiments exist from the above description of the embodiments without departing from the spirit and scope of the invention. In addition, luggage may be made with any material that is suitable. The luggage described herein may be of any sizes and for example, the luggage includes wheeled or non-wheeled luggage, soft or hard side luggage, a trunk, a suitcase, a garment bag, a tote, a duffle back, a backpack, and any types of bags.

Therefore, the foregoing description of the preferred embodiments of the invention has been presented for the purposes of illustration and description. It is not intended to be exhaustive or to limit the invention to the precise form disclosed. Many modifications and variations are possible in light of the above teaching. It is intended that the scope of the invention be limited not by this detailed description, but rather by the claims appended hereto. The above specification and examples provide a complete description of the manufacture and use of the composition of the invention. Since many embodiments of the invention can be made without departing from the spirit and scope of the invention, the invention resides in the claims hereinafter appended.

What is claimed is:

1. An expandable luggage container comprising:

a first compartment;

a side cover formed on a lateral side of the first compartment, a first zipping mechanism formed around three sides of the side cover;

a second compartment coupled to the first compartment;

a top cover formed on a top side of the second compartment, a second zipping mechanism formed around three sides of the top cover; and a retractable telescopic pull hand that is configured to be stored in a back pocket formed at a back side of the luggage container when the pull hand is completely retracted, wherein:

a first opening of the first compartment and a second opening of the second compartment are directed to different directions;

the second compartment is collapsible by a third zipping mechanism formed between the first compartment and second compartment;

the luggage container is in a compact mode when the second compartment is collapsed and is in an expanded mode when the second compartment is expanded by unzipping of the third zipping mechanism;

the second compartment is configured to receive a small item sized to be placed in the collapsed second compartment when the top cover is open in the compact mode;

the back pocket has a fourth zipping mechanism; and the pull hand is extended from the back pocket when the back pocket is open by the fourth zipping mechanism;

the second compartment comprises a passage formed on a back side of the second compartment;

the passage is concealed in the compact mode; and the extended pull hand passes through the passage in the expanded mode.

2. The luggage container of claim 1, wherein the first compartment and the second compartment are connected such that a single expanded compartment is formed in the expanded mode.

3. The luggage container of claim 1, further comprising a spacer formed between the first compartment and the second compartment such that two separate compartments are formed in the expanded mode.

4. The luggage container of claim 1, wherein the luggage container is sized to be a carry-on luggage for air travel in the compact mode such that the luggage container is storable under a seat of a plane.

5. The luggage container of claim 1, wherein a size of the second compartment is smaller than a size of the first compartment.

6. The luggage container of claim 1, wherein the third zipping mechanism is formed below the second zipping mechanism.

7. The luggage container of claim 6, wherein tracks of the third zipping mechanism are longer than tracks of the second zipping mechanism.

8. The luggage container of claim 1, wherein the third zipping mechanism is formed along four lateral sides of the luggage container.

9. The luggage container of claim 8, wherein the third zipping mechanism is fully unzipped to place the luggage container in the expanded mode when a slider is moved at least 360 degrees.

10. The luggage container of claim 1, further comprising a Universal Serial Bus (USB) port on a side of the first compartment.

11. The luggage container of claim 10, further comprising:

a cable coupled to the USB port; and an inner pocket formed inside the first compartment and sized and configured to receive an electronic device or a battery pack to be coupled to the cable.

12. The luggage container of claim 1, further comprising a carrying handle formed on the top cover.

13. The luggage container of claim 1, wherein each of the first zipping mechanism and the second zipping mechanism comprises two sliders.

14. The luggage container of claim 13, wherein the third zipping mechanism comprises only one slider.

15. An expandable luggage container comprising:

a first compartment;

a side cover formed on a side of the first compartment, a first zipping mechanism formed around three sides of the side cover;

a second compartment;

a top cover formed on a top side of the second compartment, a second zipping mechanism formed around three sides of the top cover;

a retractable telescopic pull hand that is configured to be stored in a back pocket formed at a back side of the luggage container when the pull hand is completely retracted; and a spacer formed between the first compartment and the second compartment, wherein:

a first opening of the first compartment is directed to a horizontal direction and a second opening of the second compartment is directed to a vertical direction;

the second compartment is collapsible by a third zipping mechanism formed between the first compartment and second compartment;

the luggage container is in a compact mode when the second compartment is collapsed and is in an expanded mode when the second compartment is expanded by unzipping of the third zipping mechanism;

the back pocket has a fourth zipping mechanism;

the pull hand is extended from the back pocket when the back pocket is open by the fourth zipping mechanism;

the second compartment comprises a passage formed on a back side of the second compartment;

the passage is concealed in the compact mode;

the extended pull hand passes through the passage in the expanded mode; and a size of the second compartment is variable such that the second compartment is sized and configured to receive a larger item in the expanded mode while the second compartment is sized and configured to receive a smaller item in the compact mode when the top cover is open in the compact mode.

16. The luggage container of claim 15, wherein a size of the first compartment is fixed regardless of whether the luggage container is in the compact mode or in the expanded mode.

* * * * *